US012789071B2

(12) United States Patent
Whiteside et al.

(10) Patent No.: US 12,789,071 B2
(45) Date of Patent: Nov. 10, 2026

(54) TENNIS SERVE TOSS TRAINING AID

(71) Applicant: SuLu Gurus LLC, Lehigh Acres, FL (US)

(72) Inventors: Susan C. Whiteside, San Diego, CA (US); Lucille A. Giannuzzi, Fort Myers, FL (US)

(73) Assignee: SuLu Gurus LLS, Lehigh Acres, FL (US)

( * ) Notice: Subject to any disclaimer, the term of this patent is extended or adjusted under 35 U.S.C. 154(b) by 1039 days.

(21) Appl. No.: 17/982,172

(22) Filed: Nov. 7, 2022

(65) Prior Publication Data

US 2024/0149128 A1 May 9, 2024

(51) Int. Cl.
*A63B 69/38* (2006.01)

(52) U.S. Cl.
CPC ..... *A63B 69/385* (2013.01); *A63B 2214/00* (2020.08)

(58) Field of Classification Search
CPC ..... A63B 69/385
See application file for complete search history.

(56) References Cited

U.S. PATENT DOCUMENTS 2,707,071 A * 4/1955 Adams ..... A45F 5/00 224/101
3,653,660 A * 4/1972 Malhas ..... A63B 69/385 206/315.9
3,843,126 A * 10/1974 Bandy ..... A63B 67/10 473/576
3,891,174 A * 6/1975 Harvey ..... A45C 13/30 24/301
3,997,159 A * 12/1976 Malhas ..... A63B 69/385 473/464
4,023,798 A 5/1977 Pronin
4,034,981 A * 7/1977 Veneziano ..... A63B 69/385 473/464
4,141,550 A 2/1979 Denizman
4,180,262 A * 12/1979 Gabrielidis ..... A63B 69/385 473/464
4,253,664 A * 3/1981 Daulton ..... A63B 69/385 473/464

(Continued)

FOREIGN PATENT DOCUMENTS

WO WO-2008115900 A1 * 9/2008 ..... A63B 69/38

*Primary Examiner* — Peter J Iannuzzi
(74) *Attorney, Agent, or Firm* — SCHAFFER IP LAW, LLC

(57) ABSTRACT

In a method for using a tennis serve training aid of a type having a canister with an open top, the method comprises first securing a canister along an inside length of a tennis player's forearm so that an open top of the canister is adjacent the tennis player's palm. The tennis ball is then held within the tennis player's hand adjacent the canister open top. The tennis player then raises the arm to which the canister is secured and performs a player service practice toss by tossing the tennis ball in the air so that it ascends to a peak and then falls downward. Importantly, and while keeping the arm raised, the player then catches the falling tennis ball through the open top so that the ball is retained within the canister. This process is repeated to build up muscle memory from the positive feedback of repeatedly tossing and then catching the tennis ball within the canister.

12 Claims, 5 Drawing Sheets

(56) References Cited

U.S. PATENT DOCUMENTS

| | | | | |
|---|---|---|---|---|
| 4,502,685 | A | 3/1985 | Phillips | |
| 5,011,143 | A | 4/1991 | Jones | |
| 5,064,107 | A * | 11/1991 | Ascarrunz | A63B 47/001 224/678 |
| 5,518,135 | A * | 5/1996 | Freund | B65D 51/24 220/DIG. 13 |
| 7,722,485 | B2 * | 5/2010 | Balasubramanyan | A63B 69/385 124/54 |
| 7,740,550 | B1 | 6/2010 | Kaufman | |
| 8,579,735 | B2 | 11/2013 | Brenner | |
| 8,808,116 | B2 * | 8/2014 | Dodson | A63B 69/385 473/461 |
| 9,452,340 | B2 | 9/2016 | Vaught et al. | |
| 2004/0105917 | A1 * | 6/2004 | Mannion | B65D 81/3869 426/110 |
| 2008/0287223 | A1 * | 11/2008 | Bilsey | A63B 69/38 473/422 |
| 2014/0306471 | A1 * | 10/2014 | Vital, Jr. | A63B 47/02 294/19.2 |
| 2016/0045801 | A1 * | 2/2016 | Malkin | A63B 69/38 473/464 |
| 2017/0259153 | A1 | 9/2017 | Fiedler | |
| 2021/0237942 | A1 * | 8/2021 | Collins | B65D 41/10 |
| 2022/0355178 | A1 * | 11/2022 | Walton | A63B 69/38 |
| 2024/0149128 | A1 * | 5/2024 | Whiteside | A63B 69/385 |

* cited by examiner

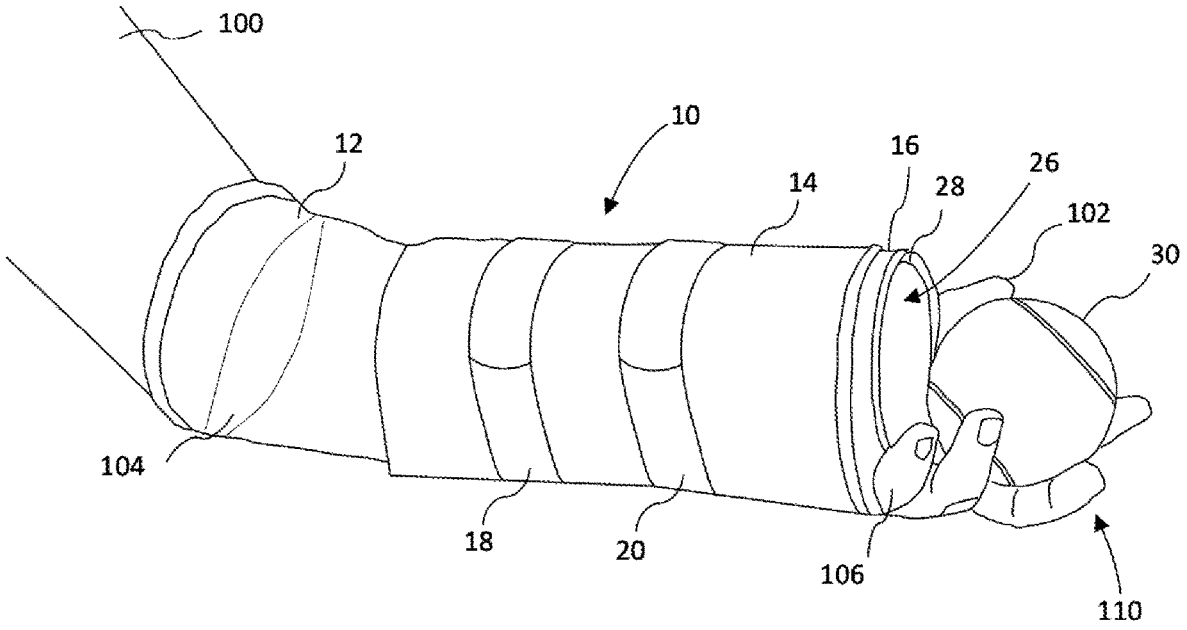
FIG. 3
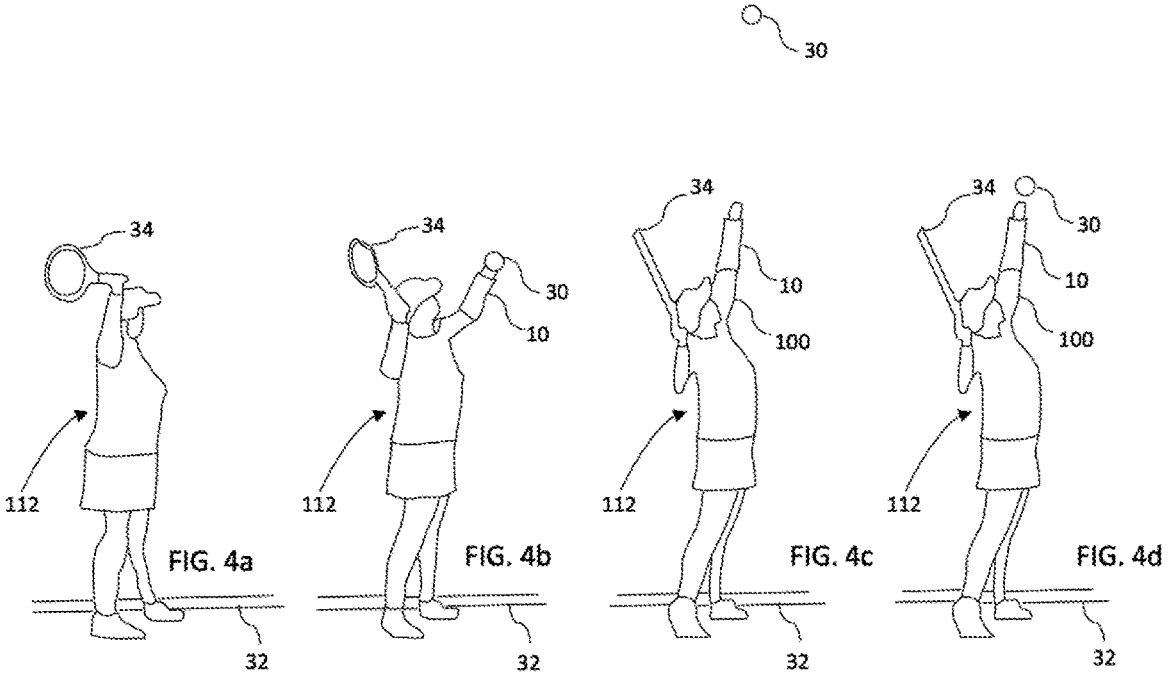

TENNIS SERVE TOSS TRAINING AID

BACKGROUND OF THE INVENTION

1. Field of the Invention

This novel invention is related to tennis training devices and methods and, more specifically, to novel training aids and methods used to improve a player's tennis serve toss.

2. Description of the Prior Art

The serve puts the tennis ball in play by subsequently hitting a tossed ball across the net with a tennis racket at or close to the ball's apex so that the ball falls into the opposite service box. The overhead serve is the most popular since it can be delivered powerfully. However, the overhead tennis serve is difficult to master and hard to teach. The toss is a critical component of the tennis serve and is often overlooked as a necessary component for service success.

Many novice tennis players suffer from the difficulty of consistently tossing a tennis ball into the optimum hitting zone to start the tennis serve. Most players do one or more of these incorrect serve toss techniques, which can cause inconsistent ball position that result in an errant serve hit: (i) they hold the ball in the palm of their hand that can cause variable ball release resulting in inconsistent toss locations, (ii) they flick or break their wrist causing the ball to be tossed behind the body and out of the optimum hitting zone, (iii) they do not toss the ball to the proper height or location causing the ball to be positioned too low, too far out in front, or too far behind the optimum hitting zone, (iv) they hook their arm (i.e., bend their elbow) causing variable ball release resulting in inconsistent ball toss location, and/or (v) they toss the ball too fast causing loss of tempo and synchronization of the serve toss and the hit with the racket swing in their hitting arm.

Many tennis serve inventions focus on the hitting portion of the serve (i.e., how the racket is to make contact with the ball) rather than the serve ball toss which is crucial to hitting a proper serve since a consistent ball toss is paramount to a consistent serve hit. These inventions discuss where and how the racket should contact the tennis ball by providing hitting target aids, visual aids, or automated ball toss machines that pre-position the ball. Some aids rely on pre-positioning a ball in the proper hitting zone by suspending a ball with a rope, string, or similar, and therefore do not instruct how to get the ball (i.e., toss it) to the proper hitting location. Other inventions discuss footwork needed for the serve. Still other inventions include targets attached to mechanical devices that the ball toss should aim for without regard to the actual arm toss mechanics.

While these known tennis serve methods potentially improve the hitting portion of the serve, these inventions lack the physical instruction or training aids on how to mechanically make the proper toss, e.g., how to hold the ball, where to hold the ball, and direct feedback to assess a successful toss. In addition, many of these aids are unwieldly and not portable. And while there may be training aids that reduce wrist movement and promotes proper ball position in the hand, such tools provide no feedback mechanism to assess a proper toss.

There is a need, therefore, for training aids that teach proper ball handling, proper ball release, proper arm position, proper toss tempo, and includes a feedback mechanism that can be used to assess the toss so that adjustments can be made to improve the toss that are also easy to wear, are light-weight, are easy to put on and take off, and can be used for right-handed or left-handed players.

SUMMARY OF THE INVENTION

A tennis serve toss training aid of a type implemented according to preferred embodiments of the invention comprises a canister having an open top configured to receive a tennis ball therethrough and a sleeve engaged with the canister and configured to secure the canister along an inside length of a tennis player's forearm such that the open top is adjacent a tennis player's palm. The canister is preferably an elongate tube adapted to run parallel along the inside length of the tennis player's forearm from palm to elbow, and is capable of retaining a plurality of tennis balls therein.

The invention also discloses a method for operating a tennis serve training aid. The method comprises securing a canister along an inside length of a tennis player's forearm, so that an open top of the canister is adjacent the tennis player's palm, and receiving a tennis ball through the open top and into an interior of the canister after a player service practice toss. The tennis ball may then be disgorged into the tennis player's palm so that the tennis player can repeat the player service practice toss.

In a method for using a tennis serve training aid of a type having a canister with an open top, the method comprises first securing a canister along an inside length of a tennis player's forearm so that an open top of the canister is adjacent the tennis player's palm. The tennis ball is then held within the tennis player's hand adjacent the canister open top. The tennis player then raises the arm to which the canister is secured and performs a player service practice toss by tossing the tennis ball in the air so that it ascends to a peak and then falls downward. Importantly, and while keeping the arm raised, the player then catches the falling tennis ball through the open top so that the ball is retained within the canister. This process is repeated to build up muscle memory from the positive feedback of repeatedly tossing and then catching the tennis ball within the canister.

In order to aid in the understanding of this invention, it can be stated that it is directed to a tennis serving toss sleeve which comprises a sleeve which has an opening for a canister, the canister fits into the attached sleeve. The canister is closed at the bottom end and has an opening at the top end which will allow a tennis ball to flow freely in and out of the canister. The canister is positioned in a pocket of the sleeve so that the canister will fit on the forearm and extend into the hand and will stop just under the pads of the fingers. When the tossing arm is lifted up and fully extended above the head it will allow the tennis ball to come out of the canister, reaching its apex, and then fall back into the canister if the toss is performed properly and at the correct pace. By having the canister attached to the sleeve the server will develop the proper toss to be made. This invention will prevent the player from flicking the wrist, sitting the ball in the palm of the hand or "holding" the ball and the canister being "lifted" not thrown will allow for the ball to come out of the canister developing a tempo which will allow for the ball to be "placed" in the hitting zone and at the correct height for proper contact. This invention will provide a teaching aid which is inexpensive and easy to use so that the teaching aid is available to many who can benefit from the use thereof.

BRIEF DESCRIPTION OF THE DRAWINGS

The foregoing and other objects, features and advantages of the invention will become more readily apparent from the following detailed description of a preferred embodiment of the invention that proceeds with reference to the accompanying drawings, in which:

FIG. 3 is a side elevation view of the tennis serve toss training aid of FIG. 1 with a tennis ball appropriately held by the fingers of the user.

FIGS. 4*a*-4*d* show use of the training aid of FIG. 1 by a tennis player in a sequence of training steps for a proper serve toss as viewed from behind the tennis court baseline.

DETAILED DESCRIPTION

Figure 1:
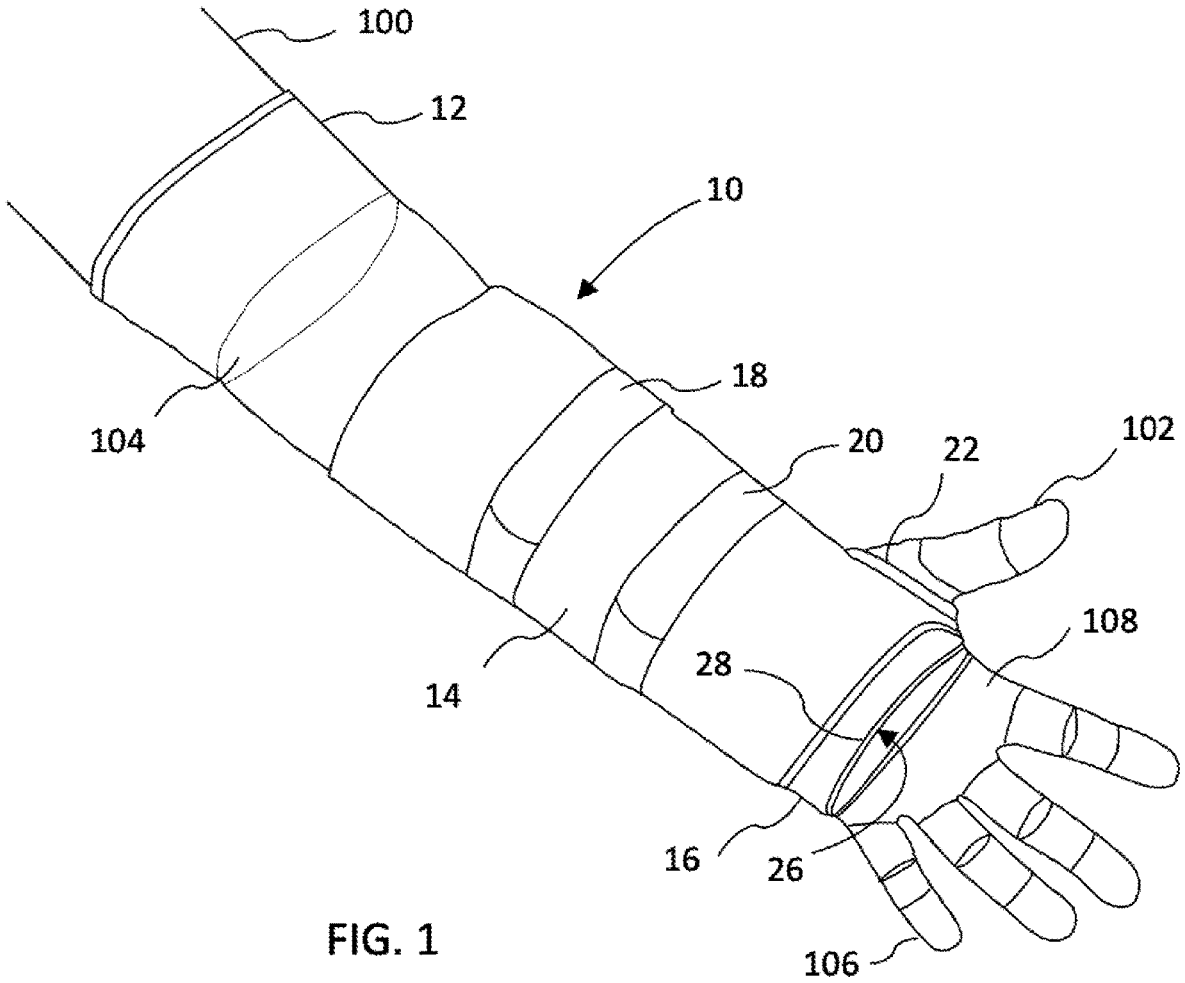
FIG. 1 is a plan view showing the tennis serve toss training aid installed on the left forearm for a right-handed tennis player according to teachings of the present invention.

FIG. 1 illustrates the tennis serve toss training aid 10 installed on the left arm 100 of a right-handed tennis player—the sleeve manufactured in a mirror image would be worn on the right arm for left-handed players. The training aid includes a sleeve 12 that is designed with a pocket 14 to accept a canister 16 as shown and held in place with attachment straps 18, 20 that are used to tighten sleeve 12 around canister 16. The sleeve 12 may be manufactured at different sizes to accommodate different sized arms. The sleeve includes an opening 22 at a distal end that fits over the thumb 102 and extends just past the elbow 104 at a proximal end. The sleeve can be manufactured with a second distal opening (not shown), opposite the first, so that the same sleeve can be worn on either the left arm 100 as shown, or on the right arm, to accommodate either right-handed or left-handed players. The open end 26 of the canister 16 is positioned such that the thumb 102 and pinkie finger 106 can be curled upward and just touch the canister outer rim 28. The canister 26 thus extends along the inside of the left forearm so that the outer rim 28 rests approximately midway up the palm 108 of the left hand. This positioning prevents the tennis ball from being palmed and allows the ball to be held only by fingers for the subsequent serve toss.

The canister 16 is preferable configured as an elongate tube adapted to run parallel along the inside length of the tennis player's forearm between the player's elbow and ending approximately midway up the player's palm. The dimensions of the elongate tube are between approximately between 6 and 12 inches in length so as to accommodate one or more tennis balls therein, to fit along the forearms of users of different sizes (and ages), and to prevent a tennis ball that falls within the elongate tube from easily rebounding from the closed bottom end and back out the open top. The open top 26 preferably has a diameter of between approximately 2.5 and 4 inches, or enough to fully receive a tennis ball therethrough. Larger diameters can be included for beginning tennis players to make it easier to catch within the canister, and canisters with smaller diameter openings can be substituted within the sleeve 20 for more experienced players for greater challenge. The canister outer rim 28 is preferably reinforced, e.g., with an annular band of metal, so that it resiliently retains its shape upon an incident impact of a tennis ball against the rim.

Figure 2:
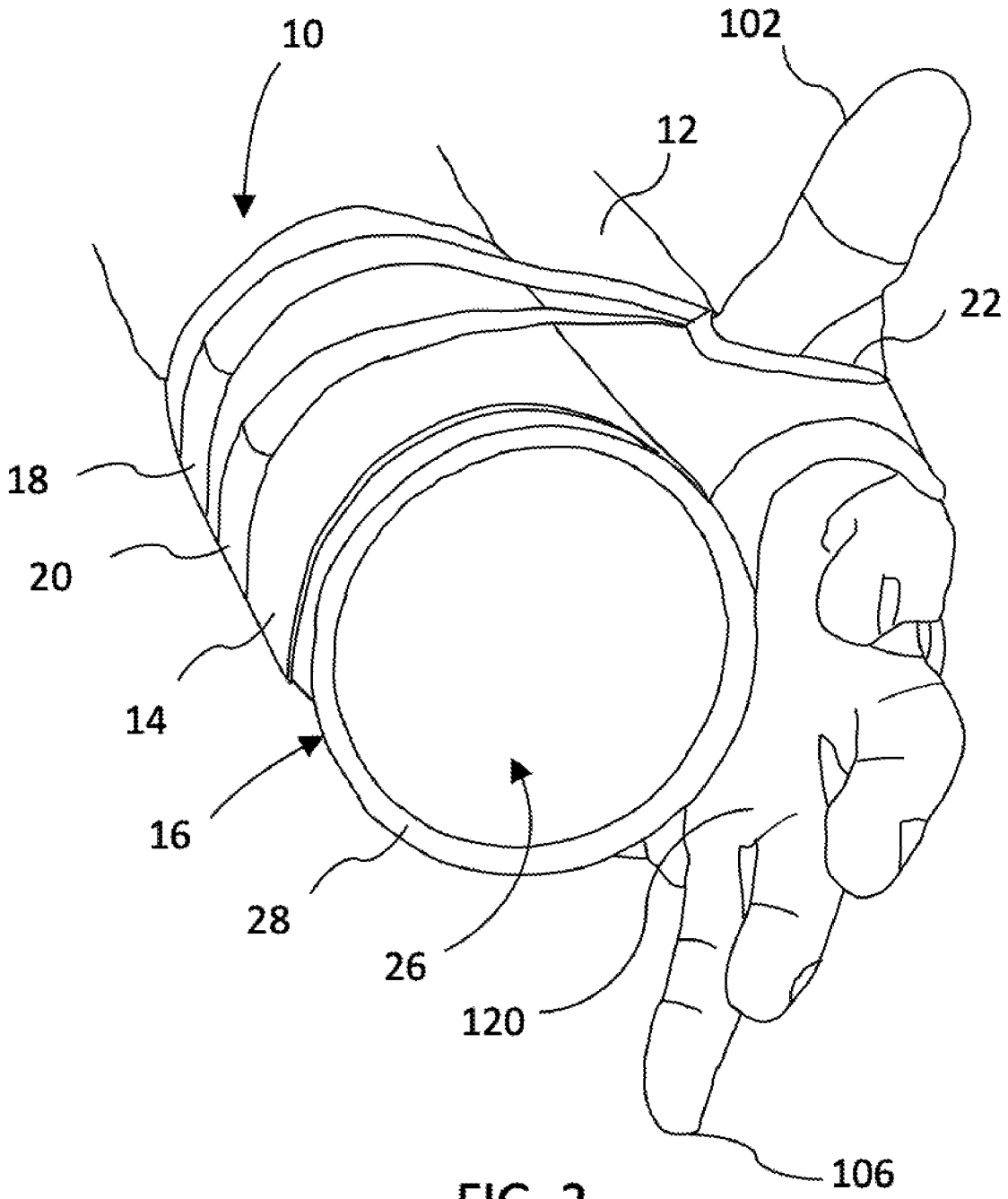
FIG. 2 is a perspective view of FIG. 1 showing the tennis serve toss training aid installed on the left forearm for a right-handed tennis player.

FIG. 2 is a frontal view of the serving aid sleeve 10 with canister 16 affixed to the arm 100. In this view, the open end 26 of the canister 16 is evident. As shown below, this open end 26 will be used as direct feedback for a successful serve toss by allowing the tossed ball to fall into the open canister.

FIG. 3 is a perspective view of the serving sleeve 10 of this invention shown on the left arm 100 with a tennis ball 30 appropriately sitting in the fingers 110. Note that the open end 26 and particularly the outer rim 28 of the canister 16, when positioned correctly halfway up the palm of the player's hand, prevents the tennis ball from being palmed.

FIGS. 4*a*-4*d* show a sequence of images of illustrating a correct toss of the ball 30 using the training aid 10 as viewed from behind the tennis court baseline 32.

FIG. 4*a* illustrates the starting point for the right-handed tennis player 112 wearing the sleeve 10 on the left arm 100. In the view, the racket 34 is started in the ready position half motion and the ball 30 is positioned within the fingers 110 (obscured from this view).

In FIG. 4*b*, the arm 100 is brought straight up readying the ball 30 for release.

In FIG. 4*c*, the momentum of the arm swing causes the ball 30 to roll off the fingertips and tossed up in the air. Note that the arm position is held in the release position after the toss (FIG. 4*c*) and if the toss is executed properly, the ball will fall back into the canister 16 mounted within the sleeve 10 with little or no movement of the arm 100 (FIG. 4*d*). Thus, the canister 16 is used as direct feedback to catch a properly tossed ball 30. If the serve toss is not produced correctly, the server will have to move their body and/or arm considerably to retrieve the tossed ball. After catching a proper toss, the arm can be positioned down to roll the ball 30 out of the canister 16 and back into the fingertips 110 for repeating the practice steps as outlined in FIGS. 4*a*-4*d*. FIGS. 4*a*-4*d* also illustrate the synchronization of the racket 34 position with the serve toss.

In the method for operating the tennis serve training aid, the canister 16 is secured along an inside length of a tennis player's forearm so that an open top of the canister is adjacent the tennis player's palm, and receiving a tennis ball through the open top and into an interior of the canister after a player service practice toss. The tennis ball may then be disgorged into the tennis player's palm so that the tennis player can repeat the player service practice toss. Preferably, the open top 26 of the canister 16 overlaps a portion of the tennis player's palm (more preferably midway up the palm) so that the tennis player is forced to at least partially hold the tennis ball with the tennis player's fingers while also preventing the player from holding the tennis ball solely within the tennis player's palm. The canister 16 is retained within the sleeve by wrapping the sleeve 10 around the tennis player's forearm, forming an elongate pocket within the sleeve, and retaining the canister within the pocket.

In the method for using the tennis serve training aid of a type having a canister 16 with an open top 26, the method comprises first securing the canister along an inside length of a tennis player's forearm so that an open top of the canister is adjacent the tennis player's palm. This securing can be accomplished by wrapping a plurality of straps around the sleeve—and preferably securing the straps using Velcro, snaps, or a buckle—to secure the sleeve to the tennis player's forearm. The tennis ball is then held within the tennis player's hand adjacent the canister open top. The tennis player then raises the arm to which the canister is secured and performs a player service practice toss by tossing the tennis ball in the air so that it ascends to a peak and then falls downward. Importantly, and while keeping the arm raised, the player then catches the falling tennis ball through the open top so that the ball is retained within the canister.

This process is repeated to build up muscle memory from the positive feedback of repeatedly tossing and then catching the tennis ball within the canister.

FIGS. 5*a*-5*d* show a sequence of images illustrating a correct toss of the ball 30 using the training aid 10 as viewed from the side, nearly parallel to the baseline 32.

Figures 5A, 5B, 5C, 5D:
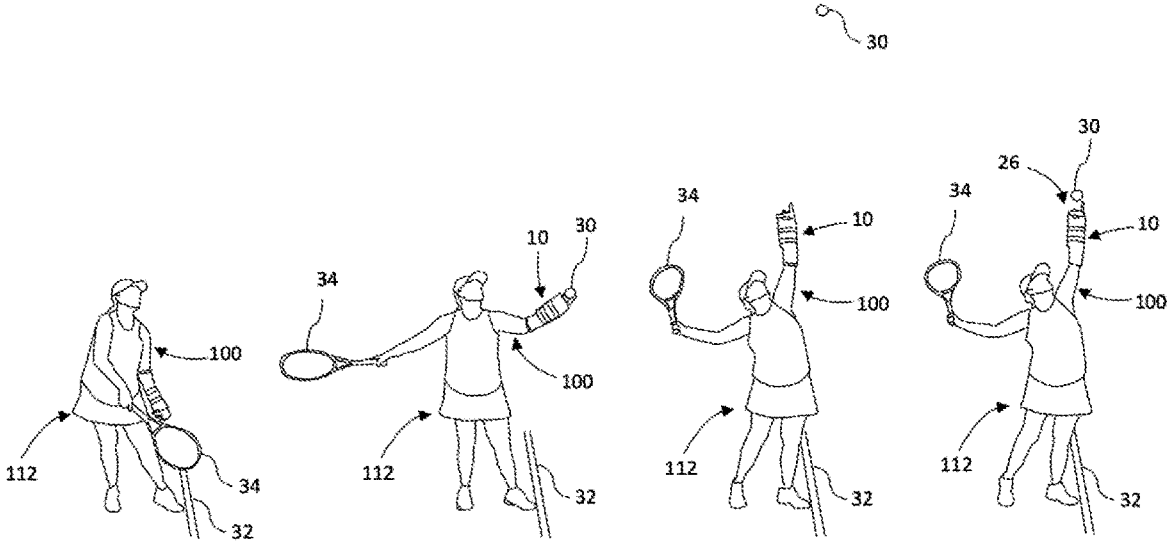
FIGS. 5*a*-5*d* show a side elevation view of the sequence of training steps of FIGS. 4*a*-4*d* as viewed from nearly parallel to the service baseline

In FIG. 5*a*, the serve begins with the racket 34 in the conventional service position and the ball 30 is held within the fingers 110 of the service toss arm with the arm 100 extended downward.

In FIG. 5*b* the arm 100 starts to come up to release the ball 30.

In FIG. 5*c*, the ball 30 is shown at or near its apex.

In FIG. 5*d*, the correctly executed toss is demonstrated since the ball 30 comes back to the extended arm 100 with the sleeve 10 and the ball enter the canister opening 26. FIGS. 5*a*-5*d* also illustrate the synchronization of the racket position with the serve toss.

Figures 6A, 6B, 6C:
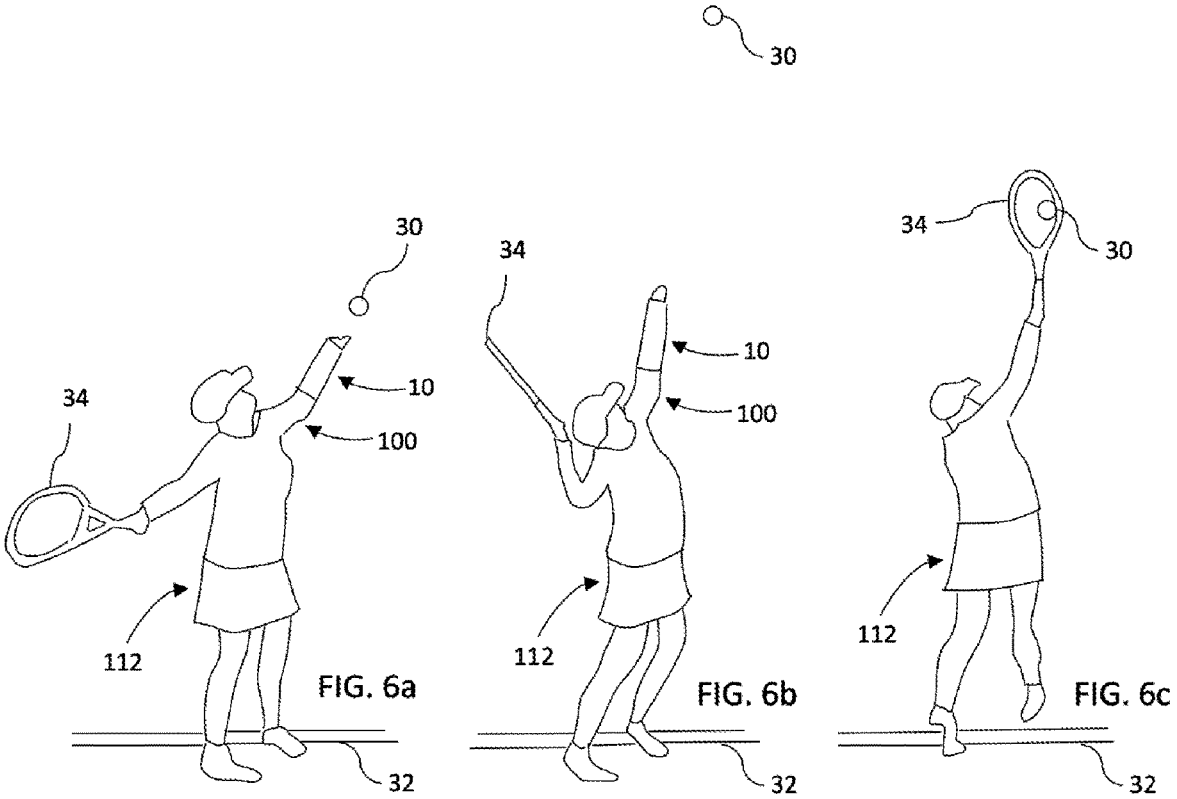
FIGS. 6*a*-6*c* show a sequence of body, ball, and racket positions for a proper service toss and racket hit as viewed from behind the tennis court baseline.

FIGS. 6*a*-6*c* and 7 show the serve sleeve aid 10 being used in conjunction with a racket hit. In FIG. 6*a* the racket extends back and up as the serve toss is executed. The racket 34 is fully back and in the ready-to-hit position as the ball 34 reaches its apex within the hitting lane (FIG. 6*b*). The racket 34 is brought forward and synchronized as the ball 30 drops within the hitting lane such that the racket can contact the ball 30 (FIG. 4*c*).

Figure 7:
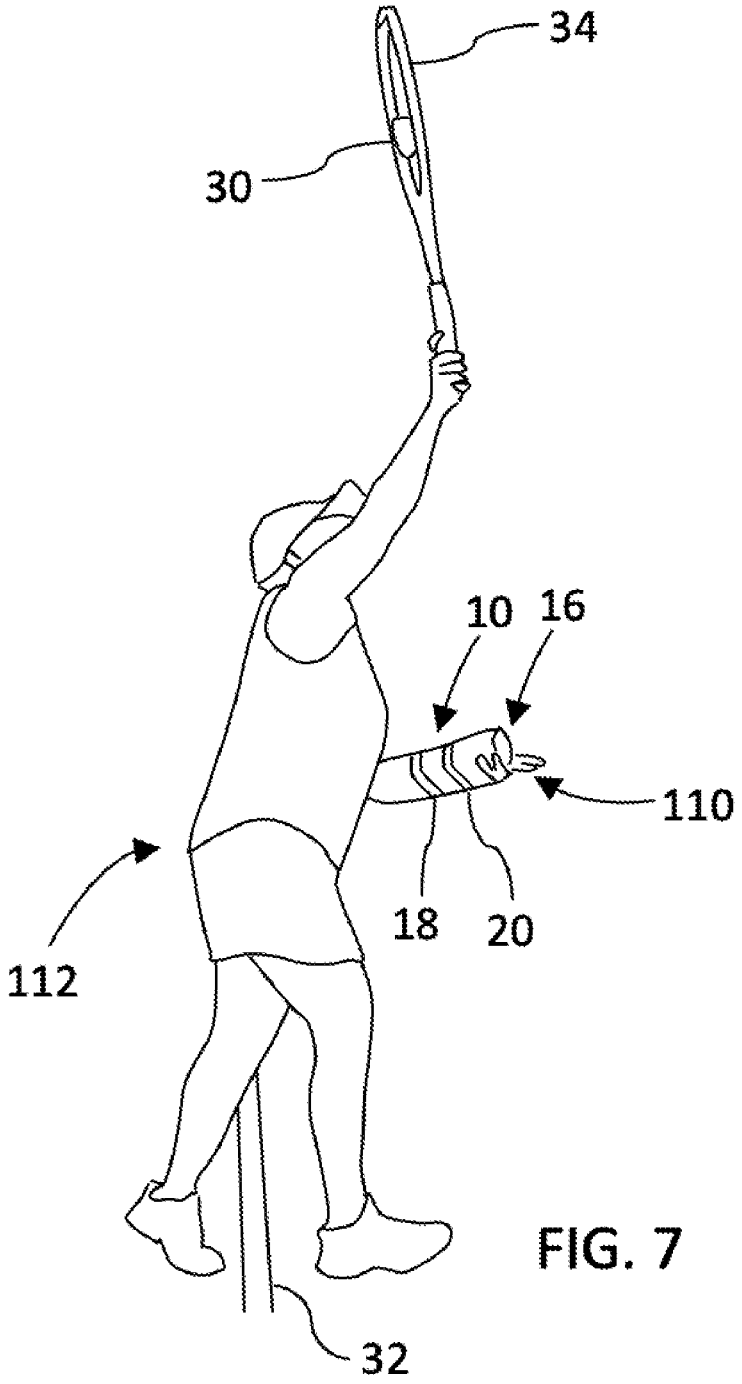
FIG. 7 shows a side elevation view of FIG. 6*c* of the body, ball, and racket position after a proper serve toss as viewed from nearly parallel to the baseline.

FIG. 7 shows a side view of a correct serve with the racket 34 making contact. The ball is slightly in front of the body so contact can be made over the head and in front of the server 112, thus allowing for the server's momentum to carry them across the baseline 32.

This novel invention aids the proper mechanics to teach a player to toss a tennis ball into the optimum hitting zone with the correct tempo, at the correct height, and at the correct distance out in front of the body for proper point of contact of the tennis racket with the tennis ball while the ball is in the air. The invention also teaches a player to correctly hold and support the tennis ball prior to the toss by keeping the ball supported and resting on the inside of the fingers and not gripped by the fingertips or within the palm of the hand. The invention and training aid reduces excessive ball rotational spin during the toss which optimizes proper racket contact. The invention also prevents flicking the wrist during the toss, avoiding inconsistent ball releases and possible improper redirection of the ball toss behind the head of the player, making it difficult to hit with the racket. The invention also encourages proper lifting of the tossing arm into the correct position out in front of the body, reinforcing the proper ball toss height and positioning within the optimized hitting zone. The invention helps with tempo and synchronization between the ball toss and opposite arm swing of the racket for hitting optimization. The invention includes a feedback mechanism so the player can make adjustments as needed to perform a proper serve toss.

When the ball is in the canister and is lifted from the top of the left leg (or right leg for a right-handed server) to extend above the head, the ball will be released with the left hand fully extended. The ball will then come out of the canister and with the hand still lifted the ball will then drop back into the canister.

Years of experience of teaching the serve have determined that certain procedures with the tossing hand are of utmost importance to achieve a repeatable toss of the tennis ball. For example, the ball should not sit in the palm of the hand, the wrist should not bend backwards, and the speed of the toss should be consistent and meticulous. The palm of the hand should be facing upward throughout the toss to avoid hooking of the toss which will put the ball outside of the hitting zone. Until this invention, no device has been known to be available for teaching the proper and consistent way to toss a ball for a consistent tennis serve. A good tennis serve requires 1) the ball to be in the hitting zone; 2) the ball not to have spin on it as it is tossed; 3) the toss elevated and timed to meet the racket in front of the hitter and at the correct height. A proper toss and proper timing of the toss to allow the ball to be struck are difficult to learn. This aid helps to create a proper toss by enabling proper placement of the ball in the fingers and providing a direct feedback mechanism for a proper toss.

Having described and illustrated the principles of the invention in a preferred embodiment thereof, it should be apparent that the invention can be modified in arrangement and detail without departing from such principles. The features of the present invention which are believed to be novel are set forth with particularity in the appended claims. We thus claim all modifications and variation that may arise within the spirit and scope of the following claims.

What is claimed is:

1. A tennis serve toss training aid, comprising:

a canister having an open top configured to receive a tennis ball therethrough; and a sleeve engaged with the canister and adapted to be worn about a tennis player's forearm, said sleeve configured to secure the canister along an inside length of and remains parallel to the forearm during movement such that the open top is adjacent a tennis player's palm so as to restrict the wrist from bending and to force the use of the finger tips only for the toss, wherein the sleeve includes a first sleeve opening adjacent a distal end thereof configured to receive a thumb therethrough.

2. The tennis serve training aid of claim 1, wherein the sleeve includes a pocket adapted to receive the canister therein.

3. The tennis serve training aid of claim 1, further including a plurality of straps configured to wrap around the sleeve and secure the sleeve to the tennis player's forearm.

4. The tennis serve training aid of claim 1, wherein the canister is an elongate tube adapted to run parallel along the inside length of the tennis player's forearm.

5. The tennis serve training aid of claim 4, wherein the elongate tube is capable of retaining a plurality of tennis balls therein.

6. The tennis serve training aid of claim 4, wherein the elongate tube has a length of between approximately 6 and 12 inches so that it extends along the tennis player's forearm from a lower palm of the tennis player to just below the elbow.

7. The tennis serve training aid of claim 1, wherein the open top has a diameter of between approximately 2.5 and 4 inches.

8. The tennis serve training aid of claim 1, where in the open top includes a reinforced outer rim adapted to resiliently retain its shape upon an incident impact of a tennis ball against the rim.

9. The tennis serve training aid of claim 8, wherein the reinforced outer rim is formed of metal.

10. The tennis serve training aid of claim 1 wherein the sleeve includes a second sleeve opening adjacent a distal end thereof, and on an opposite side of the first sleeve opening, so that the sleeve is configured for use by both right-handed and left-handed users.

11. A tennis serve toss training aid, comprising:

a elongate tube having an open top configured to receive a tennis ball therethrough into an interior of the tube; and a sleeve configured to be worn about a forearm of a tennis player and having an elongated pocket therein in alignment with the forearm adapted to receive the elongate tube therein and secure the elongate tube along an inside length of and parallel to the forearm such that the open top is adjacent a tennis player's palm and that upward movement of the forearm in a serving motion and release of the tennis ball in an upward toss causes the tennis ball to arc upward and then fall downward through the open top of the elongate tube and into the interior thereof provided the forearm remains in a proper lifted position, wherein the sleeve includes a first sleeve opening adjacent a distal end thereof configured to receive a thumb therethrough.

12. The tennis serve toss training aid of claim 11, wherein the elongate tube is further configured so as to position the open top adjacent a palm of the tennis player so that the tennis ball retained within the interior of the tube can be disgorged directly through the open top and to finger tips of the tennis player for use.

* * * * *